US006680697B2

(12) United States Patent
Bruzzone et al.

(10) Patent No.: US 6,680,697 B2
(45) Date of Patent: Jan. 20, 2004

(54) DIRECTIONAL SET OF ANTENNAS FIXED ON A FLEXIBLE SUPPORT

(75) Inventors: Raul Alberto Bruzzone, Le Mans (FR); David Joel Ezechiel Guyard, Le Mans (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/995,436

(22) Filed: Nov. 27, 2001

(65) Prior Publication Data

US 2002/0113742 A1 Aug. 22, 2002

(30) Foreign Application Priority Data

Nov. 28, 2000 (EP) ..... 00403324

(51) Int. Cl.[7] ..... H01Q 3/24
(52) U.S. Cl. ..... 342/372
(58) Field of Search ..... 342/372, 373, 342/368; 343/878, 880

(56) References Cited

U.S. PATENT DOCUMENTS

| | | | |
|---|---|---|---|
| 5,200,758 A | 4/1993 | Gillard | 343/880 |
| 5,339,086 A | 8/1994 | Deluca et al. | 342/371 |
| 5,949,369 A | 9/1999 | Bradley et al. | 342/352 |

FOREIGN PATENT DOCUMENTS

| | | | |
|---|---|---|---|
| WO | WO0026688 | 5/2000 | G01S/3/48 |
| WO | WO0007307 | 10/2000 | H04B/10/00 |

OTHER PUBLICATIONS

Patent Abstracts of Japan, Tanaka Hirokazu, "Development Type Antenna For Radar," Publication Number 59128805, Jul. 25, 1984, Application Number 58003888, Jan. 13, 1983.
European Patent Application No. 99400960.3 Entitled: Antenna Direction Finding In Mobile Phones. Inventors: Bruzzone and Rapelli. filed on Apr. 20, 1999.
By K. Fujimoto et al., Entitled: "Mobile Antenna Systems Handbook", Artech House, Inc., 1994, pp. 448–451.

*Primary Examiner*—Dao Phan
(74) *Attorney, Agent, or Firm*—Jack D. Slobod

(57) ABSTRACT

The invention relates to a controllable antenna structure (11) comprising a set of antennas (AA) arranged on a flexible support (12). Phase shifts and, in an advantageous embodiment, amplitude gains of electromagnetic current transmitted to these antennas (10), are determined by control means (13) to achieve a directive radiation pattern of the set of antennas (AA), said control means including computing means (18) which determine the radiation pattern of the set of antennas in accordance with global motion (GM) of the flexible support detected by tracking means (16), in accordance with local motion (LM) of the flexible support detected by detection means (17) and in accordance with the radio-frequency field characteristics (RF). Phase shifts and amplitude gains are transmitted to antennas via at least a phase shifter (14) and at least a gain multiplier (15).

7 Claims, 3 Drawing Sheets

DIRECTIONAL SET OF ANTENNAS FIXED ON A FLEXIBLE SUPPORT

Figure 1:
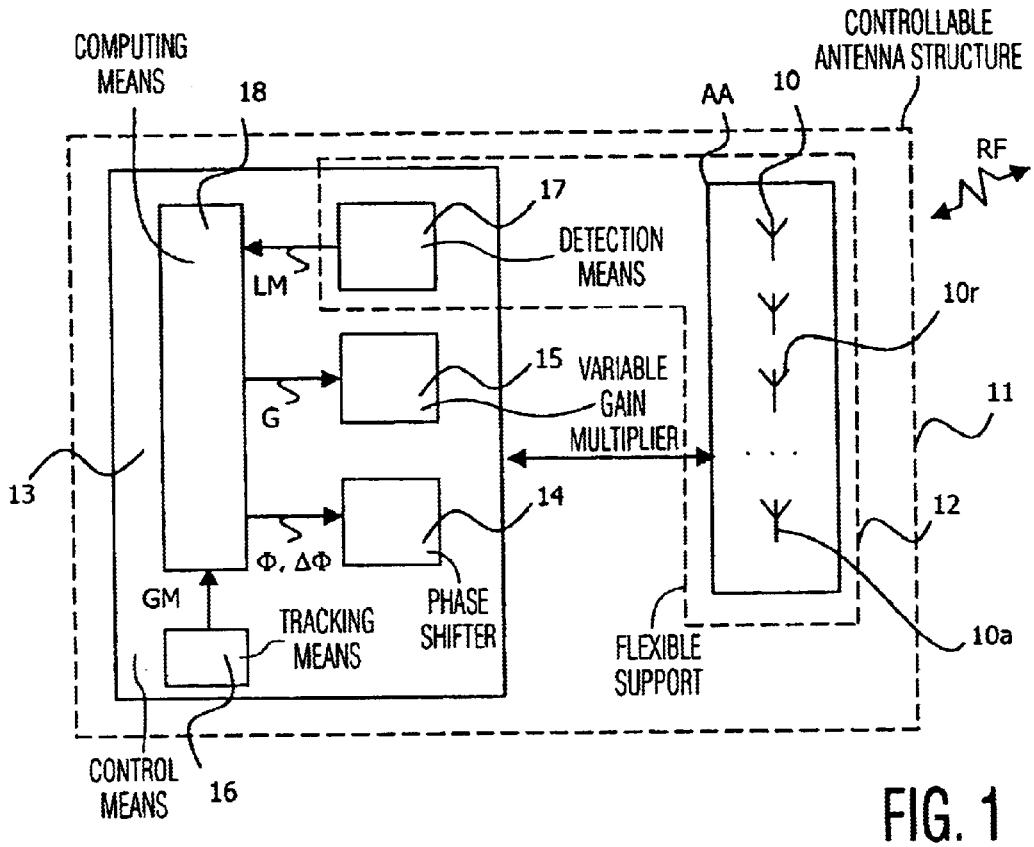

The invention relates to a controllable antenna structure comprising a set of antennas and means for controlling the set of antennas, said control means including at least one phase shifter and computing means for determining a phase shift of an electromagnetic current transmitted to or received by an antenna of the set of antennas, said phase shift being applied to said antenna to achieve a requested radiation pattern.

The present invention further relates to a radio station for use in a communication system, said radio station having such a controllable antenna structure, to a flexible support carrying such a controllable antenna structure, and to a communication system having at least one primary radio station and at least one secondary radio station, said secondary radio station having a controllable antenna structure. Said communication system may be, for example, a wireless communication system that will operate at high frequencies. Said communication system can be a terrestrial and/or a satellite cellular mobile radio system or any other suitable system.

A controllable antenna structure of the above kind is known from the handbook 'Mobile Antenna systems Handbook', K. Fujimoto et al., Artech House, Inc., 1994, pp. 448 to 451.

The known controllable antenna structure is a phased-array antenna system wherein a directive radiation pattern is obtained through the use of several antenna elements. The known controllable antenna structure is implemented in a land mobile satellite communication system. The set of antennas is fixed on the roof of a vehicle and is in communication with a primary radio station, which is a satellite.

The known set of antennas is in relation with means for controlling the radiation pattern of said set of antennas. An initial acquisition is first realized by a full azimuth search for the strongest received signal and then said control means, which include phase shifters, control the phase shift of an electromagnetic current transmitted to or received by an antenna in order to track the direction of the strongest received signal.

When several antenna elements radiate or receive with appropriate phase shifts, it is possible to achieve a desirable radiation pattern constituted of lobes in the desired directions for a phased-array antenna. The use of a phase shifting principle to achieve a requested radiation pattern of a set of antennas requires that the antennas be separated by a distance of the order of a wavelength. As an example, in third generation mobile phones the wavelength is 30 to 15 cm for a system operating in the range of 2 GHz or 1 GHz. In the above described controllable antenna structure, antennas are fixed to a large rigid structure.

A major drawback of the controllable antenna structure in accordance with the prior art is that for these mobile phones, dimensions of a rigid structure to which antennas are fixed, need to be larger than the size of the mobile equipment itself. Moreover it has to be noted that a set of antennas using the phase shifting principle needs to have a consequent number of antennas to be profitable. The less important the antenna number is, the less directive the resulting radiation pattern can be. Said radiation pattern is defined by the summation of the inherent radiation patterns of each antenna and is modified by relative phase shift changes.

The present invention takes the following aspects into consideration. A mobile user presents a large enough surface to arrange a high number of antennas. Furthermore, the invention takes into account that this surface is not necessarily a rigid surface.

It is an object of the invention to provide a controllable antenna structure as described in the first paragraph, which can be arranged on a flexible surface.

To this end, the controllable antenna structure according to the invention is characterized in that the set of antennas is fixed to a flexible support, and the controllable antenna structure further comprises means for detecting motion of the flexible support to which antennas are fixed, the computing means determining the phase shifts as a function of said motion.

The strong directivity allowed by the use of the phase shifting principle is consequently available for mobile equipment. This allows to reduce interference and to lower the power required for a communication.

Nevertheless, interference can still exist when only phase shifting is used to achieve a requested radiation pattern.

It is another object of the invention to provide a controllable antenna structure which can be steered selectively towards a given direction without being affected by parasitic information coming from other directions.

To this end, the controllable antenna structure according to the invention is characterized in that the control means further include at least one variable gain multiplier for multiplying an amplitude of the electromagnetic current transmitted or received by an antenna in order to achieve a requested radiation pattern, the computing means determining the gain as a function of said motion.

More generally, the present invention comes within the scope of mobile radio stations in a communication system that needs directional antennas. The use of directional antenna allows to increase the traffic capacity substantially, to improve the signal quality, but also to reduce electromagnetic radiation on the human body. Consequently, the present invention is also a contribution to the ensurance of providing a better service quality to users.

These and other aspects of the invention will be apparent from and elucidated with reference to the embodiments described hereinafter.

Figure 2:
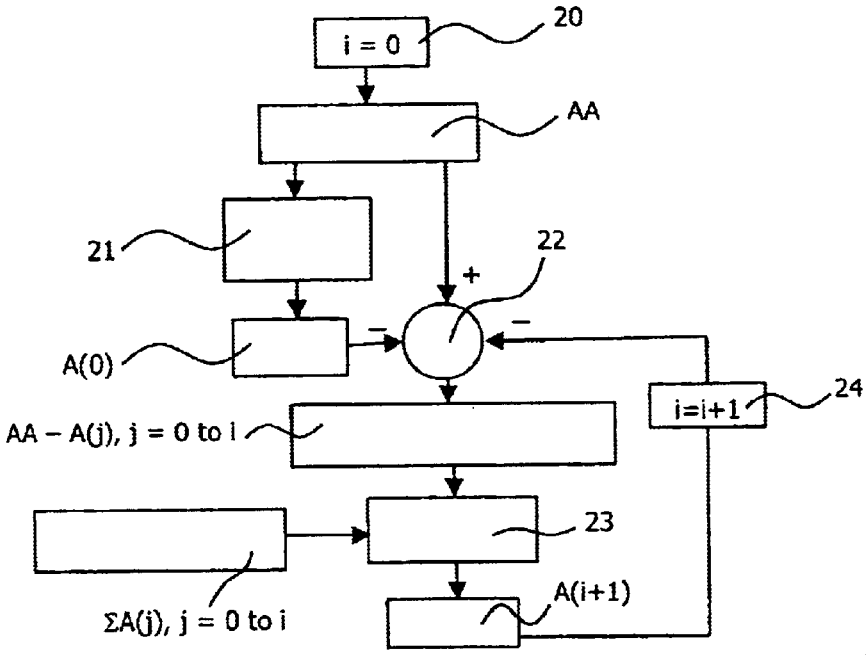
Figure 3:
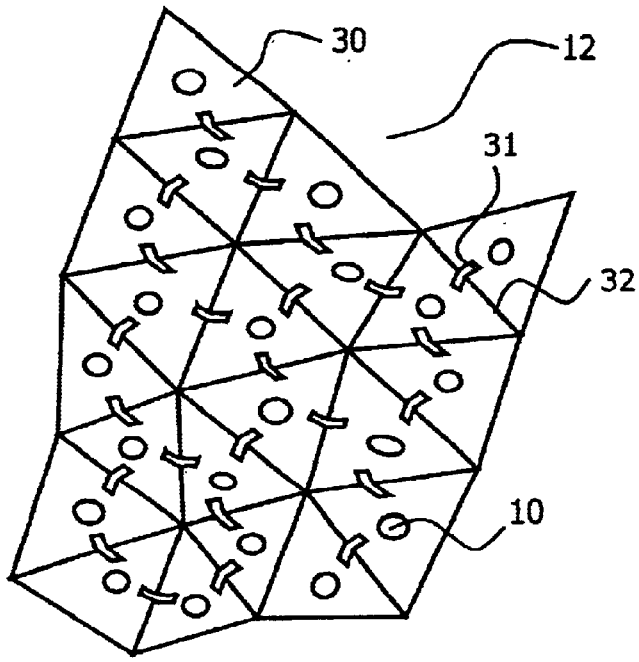
Figure 4:
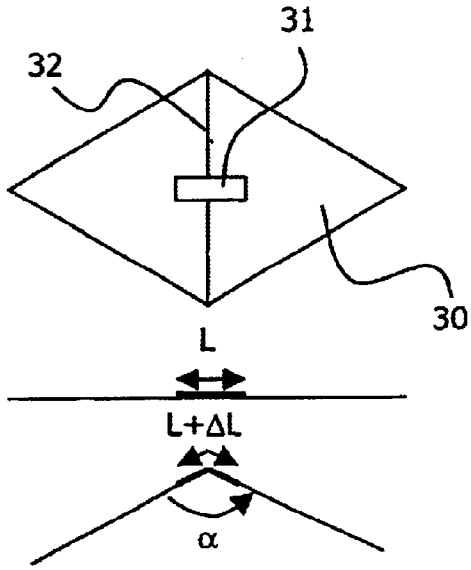
Figure 5:
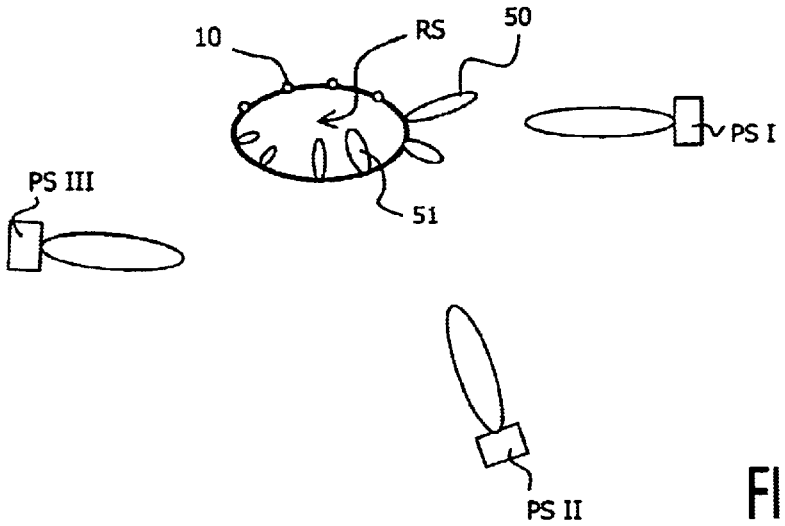
Figure 6:
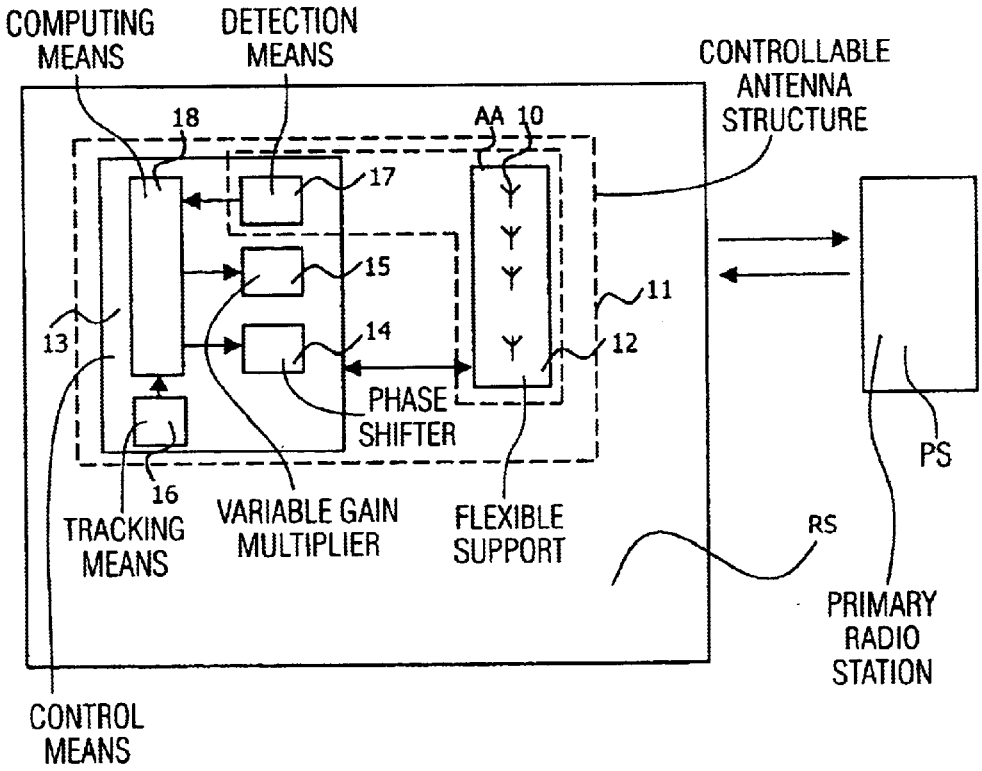

The invention is described hereafter in detail with reference to the accompanying figures wherein:

FIG. 1 is a schematic representation of a controllable antenna structure in accordance with the invention, FIG. 2 shows a diagram of a method of computing parameters of electromagnetic currents transmitted to antennas to have a directive radiation pattern, FIG. 3 is a flexible support according to the invention to which antennas are fixed, FIG. 4 shows the working principle of a strain sensor, which is used to determine local motion of the flexible support, FIG. 5 shows a communication system according to the invention comprising a controllable antenna structure including a variable gain multiplier, and FIG. 6 is a schematic representation of a radio station according to the invention in a communication system.

Like entities carry like numerals throughout the drawings.

FIG. 1 is a schematic diagram illustrating the working of a controllable antenna structure 11 according to the invention, said structure comprising a set of antennas referred to as AA. Referring to FIG. 1, each antenna 10 is arranged on a flexible support 12. Antennas 10 are linked to control means 13 for controlling the set of antennas AA. Said control means 13 include at least one phase shifter 14 to apply a phase shift ΔΦ to at least an antenna, for example 10*a*, and computing means 18 for determining the phase shift ΔΦ applied to electromagnetic current transmitted to or received by the antenna 10*a* relative to the phase of a reference antenna, for example 10*r*. Said computing means 18 determine said phase shift ΔΦ to achieve a requested radiation pattern. In an advantageous embodiment, the control means 13 further include at least one variable gain multiplier 15 to apply a gain G to the amplitude of the electromagnetic current transmitted to or received by an antenna, for example 10*a*, and computing means 18 include means for determining the variable gain G applied to electromagnetic current transmitted to or received by the antenna 10*a*. Said computing means 18 determine said gain G to achieve a requested radiation pattern.

The set of antennas AA is mobile and it is possible to break down the absolute motion of antennas 10 into:

- a motion of the controllable antenna structure 11 as a whole, hereinafter referred to as global motion GM; and
- a motion of the flexible support 12 itself, this motion defining a local motion LM of antennas 10 with respect to a reference position of said antennas.

These two kinds of motion imply changes in the position of antennas 10 in a radio-frequency field wherein the controllable antenna structure is located, said radio-frequency field comprising at least a radio-frequency signal RF, which is created by at least a primary radio station by which a communication is requested. These changes require that phase shifts and, in an advantageous embodiment, gains, of electromagnetic currents transmitted to or received by each antenna 10 are determined again to obtain a directive radiation pattern pointed towards the primary radio station that emits the desired signal.

First, as the controllable antenna structure 11 is generally part of a mobile equipment, global motion of the controllable antenna structure 11 is generally frequent. In the present invention, control means 13 include means 16 for tracking a global motion of the controllable antenna structure 11 in the radio-frequency field. Tracking means 16 are, for example, a tracking unit of the kind exposed in international patent application WO 00/26688, performing a signal direction tracking based on the phase difference of a signal received by different antennas. In another example described in still non-published European patent application n° 99400960.3 (attorney's docket PHF99529), the tracking is based on the knowing of a mobile's position and motion relative to a fixed coordinate system. Tracking means 16 generally quantify the global motion of the controllable antenna structure 11 in the radio-frequency field. Computing means are provided with data from means for tracking 16, so that said computing means 18 determine phase shifts to achieve a requested radiation pattern in accordance with these data.

Secondly, referring to FIG. 1, the controllable antenna structure 11 further comprises means 17 for detecting motion of the flexible support 12. These detection means 17 can provide the computing means 18 with two kinds of data: in a first embodiment, with Boolean data indicating if there is motion or if there is not any motion of the flexible support 12; or, in a second embodiment, with data that quantify the local motion of the flexible support 12.

In the first embodiment, computing means 18 are able to activate a method comprising a step of redetermination of parameters such as phase shifts and amplification gains of electromagnetic currents transmitted to or received by antennas 10.

Referring to FIG. 2, the step of redetermining of the parameters of electromagnetic currents is realized by a pointing process. In an initialization step 20, a counter i is set to zero. Then every antenna of the set of antennas AA is sequentially scanned in a first processing step 21 in order to select the one that provides the best received signal for a given direction that carries a desired signal. This antenna will be used as the reference antenna and is labeled A(0). A(0) is subtracted in a subtraction step 22 from the set of antennas AA. The remaining group of antennas constitutes the set of remaining antennas called AA—A(j), j=0 to i. As i=0 at this level of the pointing process, the remaining antennas are the whole set of antennas except A(0). These remaining antennas are processed independently in a second processing step 23. In the second processing step 23, a 180 degrees sweep of the phase shift of each antenna relative to the phase of A(0), which is denoted ΣA(j), j=0 to i, A(0) being this summation for i=0, is realized independently for each antenna. The summation of the signal obtained from the antenna under process during the phase sweep with the signal from A(0), is evaluated. The maximum value is recorded in a table for each antenna. After repeating the process with all possible antennas of AA—AP(j), j=0 to i, the table is analyzed, and the prospective first antenna partner: A(1) with the phase shift that provides the highest value, is selected. This first iteration provides the two best positioned antennas, and their relative phase-difference. In a next step 24, the counter is incremented by i=i+1 and in next iterations, successive antenna partners A(i+1) are selected. In the processing step 23, a 180 degrees sweep of the phase shift of each antenna of AA—A(j), j=0 to i, is realized. A summation of the signal obtained from the antenna under process during the phase sweep with the signal obtained by the summation of signals from previously selected antenna partners, is evaluated. The summation of signals from previously selected antenna partners is labeled as ΣA(j), j=0 to i, said signals from selected antenna partners being the ones obtained using phase shifts that give the highest value for the summation of signals from previously selected antenna partners. The maximum value is recorded in a table for each antenna. After repeating the process with all possible antennas of AA—AP(j), j=0 to i, the table is analyzed, and the prospective next antenna partner: A(i+1) with the phase shift that provides the highest value, is selected. In a particular embodiment, the processing is repeated as many times as antenna 10 occurs, each step selecting an antenna being A(i+1) and, then, incrementing i to i+1 (24). After these iterations, the complete antenna array is in place, with the relative phase shifts of each antenna partner with reference to A(0). In another particular embodiment, this pointing process is realized on a limited number of antennas for reasons of implementation costs.

As this determination of parameters costs resources, this pointing process should only be activated on rare occasions: for example, a very large motion or a motion in an implementation of the invention where motions are rare. This is, for example, the case with an implementation of the invention in a belt: as soon as the belt is attached, the flexible support, which is the belt itself, rarely has motions. For example, a strain sensor can be implemented on the belt as detection means 17 for detecting the motion of the flexible support 12. This strain sensor transmits data indicating that there is motion or that there is no motion to computing means 18. A determination of parameters is realized when computing means 18 receive data indicating that there is motion. Otherwise parameters are only modified according to data from tracking means 16. The implementation in a belt is advantageous as antennas can be spread around the mobile equipment carrier and consequently can cover a 360° radio-frequency field.

Motion detection means 17 that provide data which quantify the local motion of the flexible support 12 are especially useful when motion of flexible support 12 is frequent. This is for example the case when antennas are fixed to a cloth.

Referring to FIG. 3, the flexible support 12 is a set of rigid equilateral triangles 30 of the same size moving relative to each other. This configuration can be considered a model of the flexibility of any flexible support as soon as the size of equilateral triangles 30 is sufficiently small to assume that each triangle is not significantly deformed due to shape changes of the flexible support 12. The triangular shape can be replaced by any kind of geometric shapes allowing to cover the flexible support by several elements of this shape without departing from the scope of the invention. In the embodiment as illustrated in FIG. 3, antennas 10 are fixed at the center of each equilateral triangle 30 and strain sensors 31 are fixed at the junction edge 32 between different triangles. For example, said strain sensors are varying resistance sensors. Their working principle is illustrated in FIG. 4: when an edge 32 is bent, the length of the sensor increases and the resistance of the sensor is modified by a quantity depending on the angle $\alpha$ of torsion of the edge and of the length modification $\Delta L$ of the sensor length L. Consequently, these sensors 31 provide data on changes of position of each triangle with respect to the surrounding triangles. These data allow to know the relative position of antennas 10 relative to others and to quantify the local motion of antennas 10. The knowledge of this local motion allows to know the evolution of the position of antennas with respect to an initial reference position of antennas. The initial reference position is defined as being a position for which phases of electromagnetic current transmitted to or received by each antenna have been determined to have a requested radiation pattern. This determination requires a pointing process similar to the one presented above, said pointing process being realized for this given initial reference position. The pointing process could be executed, for example, at regular time intervals to have a regular refreshment of the reference position of the set of antennas or only at a given level of motion of the flexible support 12 detected by detection means or at a given level of motion of the controllable antenna structure 11 detected by tracking means.

Data from strain sensors 31, allowing to continuously know the changing position of the set of antennas, are applied in real time to computing means to be used in the determination of phase shifts and, in an advantageous embodiment, of gains. Knowing this changing position of the set of antennas avoids executing a pointing process with each movement of the flexible support. Effectively, between two pointing processes, computing means use the geometrical configuration to determine the phase shifts and, in an advantageous embodiment, power gains, of electromagnetic current transmitted to antennas, said phase shifts allowing to keep the requested radiation pattern even during local motion of antennas due to motion of the flexible support. This determination processed by computing means 18 uses data provided by tracking means, data provided by strain sensors which provide the positions of antennas 10 relative to each other, initial condition data determined during a previous pointing process and data provided by the set of antennas itself on the radio-frequency field.

FIG. 5 illustrates a communication system using a controllable antenna structure 11 of the invention in a radio station RS. In an advantageous embodiment of the invention, referring to FIG. 5, control means comprise a variable gain multiplier to control the value of the amplitude of each electromagnetic current transmitted to or received by antennas 10. In the case of a radio-frequency field resulting from the emission of several primary radio stations PS I, PS II, PS III as represented on FIG. 5, some primary radio stations, PS II, PS III for example, have a parasitic effect for the communication between the primary radio station PS I and the radio station RS where a set of antennas according to the invention is implemented. In such a case, the variable gain multiplier allows to allocate a negative gain to a given number of antennas in order to lower the influence of parasitic signals coming from parasitic primary radio stations on the communication between the set of antennas and the primary radio station PS I. Referring to FIG. 2, the allocation of this variable gain is realized in processing step 23 using a sweeping of values of the gain between two values depending on the characteristics of the gain multiplier. Said sweeping is realized independently for each antenna. The gain sweeping can be used for the selection of the antenna partner A(i+1). In this case, values are recorded during the gain sweeping realized, for example, in parallel with the phase shift sweeping or after the phase shift sweeping. After repeating the process with all possible antennas, the table is analyzed, and the prospective next antenna partner: A(i+1) with the phase shift and the gain, which provide the highest resulting signal received from the primary radio station PS I, is selected.

The gain sweeping can also be used after the selection of the antenna partner A(i+1) and its phase shift that gives a maximum value to the resulting signal. In this case, the selected gain is the one that gives the highest value for the summation of the signal obtained from the antenna under process during the gain sweeping with the signal obtained by the summation of signals from previously selected antenna partners with selected phase shifts and gains, said signals being the ones received from PS I. The radiation pattern of the set of antennas that minimize the radiation power required by the communication with PS I is consequently obtained. A figurative example is given in FIG. 5 showing schematic positive lobes 50 and negative lobes 51 in different directions. Data from tracking means can also be used to determine the gain value.

Referring to FIG. 6, which describes a radio station in a communication system according to the invention, said communication system has at least one primary radio station PS and at least one secondary radio station RS, said secondary radio station RS being a radio station according to the invention. Said secondary radio station RS has a controllable antenna structure 11 comprising a set of antennas AA fixed to a flexible support 12. Said set of antennas AA is controlled by control means 13 including at least one phase shifter 14 and computing means 18 for determining a phase shift of an electromagnetic current transmitted to or received by, at least, an antenna 10 of the set of antennas AA. The controllable antenna structure further comprises motion detection means 17 for detecting motion of the flexible support 12 to which antennas are fixed, the computing means determining the phase shifts as a function of said motion. Said phase shift is applied to said antenna to steer the controllable antenna structure towards the primary radio station.

A controllable antenna structure according to the invention can be arranged on cloth or any kind of flexible structure, and can be arranged, as an example, on garments, accessories such as belts, watch bands, bags as long as the size of such objects is compatible with the separation between two antennas required by the value of the frequency of the communication.

The invention can also be implemented on any mobile equipment that has a flexible part. It is also possible to implement the invention in a "personal net" comprising, for example, several radio stations, such as, for example a screen and a phone terminal, each station requiring antennas for communicating with each other. Controllable antenna structures according to the invention can be advantageously used on the user' clothes. Communication links between an element using a set of antennas according to the invention and the radio station using the received signal can be a link by cable or a link by radio frequency waves as, for example, a Bluetooth link.

What is claimed is:

1. A controllable antenna structure (11) comprising a set of antennas (AA) and means for controlling (13) the set of antennas, said control means including at least one phase shifter (14) and computing means (18) for determining a phase shift of an electromagnetic current transmitted to or received by an antenna (10) of the set of antennas (AA), said phase shift being applied to said antenna to achieve a requested radiation pattern, characterized in that the set of antennas (AA) is fixed to a flexible support (12), and the controllable antenna structure further comprises means for detecting motion (17) of the flexible support to which antennas are fixed, the computing means (18) determining the phase shifts as a function of said motion.

2. A controllable antenna structure (11) as claimed in claim 1, characterized in that the motion detection means (17) comprise strain sensors (31) arranged on the flexible support (12), the computing means (18) determining the phase shifts as a function of strain measurements provided by said sensors (31).

3. A controllable antenna structure (11) as claimed in claim 1, characterized in that control means (13) further include at least one variable gain multiplier (15) for multiplying an amplitude of the electromagnetic current transmitted to or received by an antenna (10) of the set of antennas (AA) in order to achieve the requested radiation pattern, the computing means (18) determining the gain as a function of said motion.

4. A radio station for use in a communication system, said radio station having a controllable antenna structure (11) comprising a set of antennas (AA) and means for controlling (13) the set of antennas, said control means including at least one phase shifter (14) and computing means (18) for determining a phase shift of an electromagnetic current transmitted to or received by an antenna (10) of the set of antennas (AA), said phase shift being applied to said antenna to achieve a requested radiation pattern, characterized in that the set of antennas (AA) is fixed to a flexible support (12), and the controllable antenna structure further comprises means for detecting motion (17) of the flexible support to which antennas are fixed, the computing means (18) determining the phase shifts as a function of said motion.

5. A communication system having at least one primary radio station and at least one secondary radio station, said secondary radio station having a controllable antenna structure (11) comprising a set of antennas (AA) and means for controlling (13) the set of antennas (AA), said control means (13) including at least one phase shifter (14) and computing means (18) for determining a phase shift of an electromagnetic current transmitted to or received by an antenna (10) of the set of antennas (AA), said phase shift being applied to said antenna (10) to steer the controllable antenna structure (11) towards the primary radio station, characterized in that the set of antennas (AA) is fixed to a flexible support (12), and the controllable antenna structure (11) further comprises means for detecting motion (17) of the flexible support (12) to which antennas are fixed, the computing means (18) determining the phase shifts as a function of said motion.

6. A communication system as claimed in claim 5, comprising a set of primary radio stations, characterized in that the control means (13) further include at least one variable gain multiplier (15) for multiplying an amplitude of the electromagnetic current transmitted or received by an antenna (10) in order to steer the controllable antenna structure (11) towards at least one primary radio station without being much affected by the other primary radio stations.

7. A controllable antenna structure (11) comprising a flexible support carrying a set of antennas (AA) and means for detecting motion (17) of the different antennas on the flexible support, said motion being intended to be fed to means for controlling (13) a radiation pattern of said set of antennas with respect to said motion.

* * * * *